US009780486B2

(12) United States Patent
Tanaka

(10) Patent No.: US 9,780,486 B2
(45) Date of Patent: Oct. 3, 2017

(54) CONNECTOR

(71) Applicant: Japan Aviation Electronics Industry, Limited, Tokyo (JP)

(72) Inventor: Yukitaka Tanaka, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/337,037

(22) Filed: Oct. 28, 2016

(65) Prior Publication Data

US 2017/0179644 A1 Jun. 22, 2017

(30) Foreign Application Priority Data

Dec. 17, 2015 (JP) ..... 2015-246353

(51) Int. Cl.
*H01R 13/627* (2006.01)
*H01R 13/639* (2006.01)

(52) U.S. Cl.
CPC ..... *H01R 13/6275* (2013.01); *H01R 13/6273* (2013.01); *H01R 13/639* (2013.01)

(58) Field of Classification Search
CPC ..... H01R 13/6273; H01R 13/6275; H01R 13/639
See application file for complete search history.

(56) References Cited

U.S. PATENT DOCUMENTS 6,257,914 B1 * 7/2001 Comerci ..... H01R 13/6273 439/357
6,641,425 B1 11/2003 Wu
6,865,369 B2 * 3/2005 Semmeling ..... H01R 13/6275 434/357
7,163,413 B2 * 1/2007 Murayama ..... H01R 13/6272 439/258

(Continued)

FOREIGN PATENT DOCUMENTS

JP 2541592 Y 4/1997
JP 2009-123627 A 6/2009

(Continued)

*Primary Examiner* — James Harvey
*Assistant Examiner* — Oscar C Jimenez
(74) *Attorney, Agent, or Firm* — Collard & Roe, P.C.

(57) ABSTRACT

A connector includes a connector main member and an operation member. The operation member covers the connector main member at least in part in a plane perpendicular to a front-rear direction, The operation member is movable between a front limitation position and a rear limitation position. The operation member has, therein, a front regulating portion accommodation portion accommodating the front regulating portion, and an operated portion accommodation portion accommodating the operated portion. The front regulating portion accommodation portion is provided, therein, with a front regulated portion which is brought into abutment with the front regulating portion when the operation member is positioned at the front limitation position. When the operation member is moved to the rear limitation position, the operated portion accommodation portion is (Continued)

provided, therein, with an operating portion which presses the operated portion inward of the connector main portion and moves the lock portion to a released position.

19 Claims, 12 Drawing Sheets

(56) References Cited

U.S. PATENT DOCUMENTS

| | | | | |
|---|---|---|---|---|
| 7,175,465 | B1 * | 2/2007 | Tsai | H01R 13/6275 439/352 |
| 7,258,565 | B2 * | 8/2007 | Huang | H01R 13/6275 439/353 |
| 7,591,664 | B2 | 9/2009 | Nomiyama et al. | |
| 7,604,496 | B2 * | 10/2009 | Takeuchi | H01R 13/6275 439/358 |
| 8,025,511 | B2 * | 9/2011 | Aihara | H01R 13/4538 439/141 |
| 9,197,015 | B2 | 11/2015 | Tanaka et al. | |
| 9,246,262 | B2 * | 1/2016 | Brown | H01R 13/62 |
| 9,331,428 | B2 | 5/2016 | Kawamura et al. | |
| 9,397,442 | B2 * | 7/2016 | Sutter | H01R 24/62 |
| 2006/0141843 | A1 * | 6/2006 | Huang | H01R 13/6275 439/350 |
| 2010/0285683 | A1 * | 11/2010 | Zhang | H01R 13/6275 439/357 |
| 2015/0229075 | A1 * | 8/2015 | Lin | H01R 13/635 439/153 |

FOREIGN PATENT DOCUMENTS

| | | | |
|---|---|---|---|
| JP | 5500744 | B1 | 5/2014 |
| JP | 2014-127433 | A | 7/2014 |
| JP | 2014-165151 | A | 9/2014 |
| JP | 2015-170439 | A | 9/2015 |

* cited by examiner

CONNECTOR

CROSS REFERENCE TO RELATED APPLICATIONS

This application is based on and claims priority under 35 U.S.C. §119 to Japanese Patent Application JP2015-246353 filed Dec. 17, 2015, the contents of which are incorporated herein in their entirety by reference.

BACKGROUND OF THE INVENTION

This invention relates to a connector which is provided with a lock portion used to lock a mating state of the connector with a mating connector.

A connector of this type is, for example, disclosed in JPA2014-127433 (Patent Document 1). As shown in FIGS. 17 to 19, a connector 900 of Patent Document 1 has a connector body 910, lock members 920, a tab 930 and a holding member 940. The lock members 920 are attached to the connector body 910. The connector body 910 and the tab 930 are held by the holding member 940. As understood from FIGS. 18 and 19, the connector body 910 is relatively unmovable with respect to the holding member 940 while the tab 930 is relatively movable with respect to the holding member 940 in a front-rear direction (an X-direction). The lock members 920 are each provided with an operated portion 922 while the tab 930 is provided with an operation portion 932. When the tab 930 is positioned at a front limitation position (FIG. 18), the operated portions 922 of the lock members 920 are located above an upper surface 912 of the connector body 910 and protrude upward (in a positive Z-direction). At this time, lock portions 924 are positioned at a locked position to protrude from the upper surface 912 by a predetermined amount. When the tab 930 is pulled backward (in a negative X-direction) (FIG. 19), the operation portion 932 of the tab 930 pushes down the operated portions 922 of the lock members 920 within the connector body 910. As a result, the lock portions 924 are moved to a released position which is located downward (in a negative Z-direction) of the locked position.

In the connector 900 disclosed in Patent Document 1, the tab 930 which is relatively movable with respect to the holding member 940 is positioned inside the holding member 940 in part. Accordingly, the connector has a problem that assembly ability is inferior.

SUMMARY OF THE INVENTION

It is an object of the present invention to provide a connector which is provided with a lock portion and which is improved assembly ability.

One aspect of the present invention provides a connector which is mateable with a mating connector along a front-rear direction. The connector comprises a connector main member and an operation member. The connector main member has a fitting portion, a lock portion, an operated portion, a front regulating portion and a rear regulating portion. The lock portion is located in the fitting portion. The operated portion is located rearward of the fitting portion. The front regulating portion is located rearward of the fitting portion. The lock portion is interlocked with the operated portion. The lock portion is movable between a locked position and a released position. The lock portion protrudes from the fitting portion by a predetermined amount when the lock portion is positioned at the locked position. The lock portion does not protrude from the fitting portion when the lock portion is positioned at the released position, or the lock portion protrudes from the fitting portion by an amount smaller than the predetermined amount when the lock portion is positioned at the released position. The operation member covers the connector main member at least in part in a plane perpendicular to the front-rear direction. The operation member has a front limitation position and a rear limitation position in the front-rear direction. The front limitation position and the rear limitation position are defined by the front regulating portion and the rear regulating portion, respectively. The operation member is movable between the front limitation position and the rear limitation position in the front-rear direction. The operation member has, therein, a front regulating portion accommodating portion accommodating the front regulating portion and an operated portion accommodating portion adapted to accommodate the operated portion. The front regulating portion is always positioned inside the front regulating portion accommodating portion. The front regulating portion accommodating portion is provided with a front regulated portion therein. The front regulated portion is brought into abutment with the front regulating portion when the operation member is positioned at the front limitation position. The operated portion accommodating portion is provided with an operating portion therein. When the operation member is moved to the rear limitation position, the operating portion presses the operated portion inward of the connector main member to move the lock portion to the released position.

In the present invention, the operation member can be attached to the connector main member by only covering the connector main member from the front thereof with the operation member. Therefore, assembly ability of the connector is improved.

An appreciation of the objectives of the present invention and a more complete understanding of its structure may be had by studying the following description of the preferred embodiment and by referring to the accompanying drawings.

Figure 1:
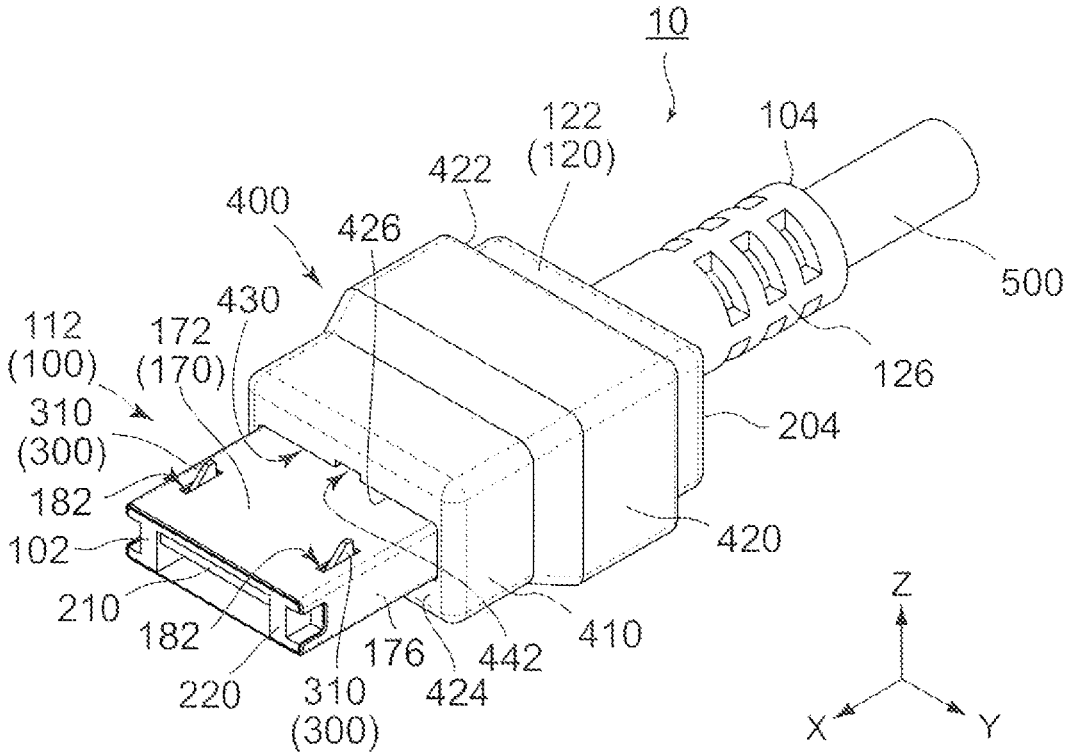
FIG. 1 is a perspective view showing a connector according to an embodiment of the present invention. A front hood illustrated is positioned at a front limitation position.
Figure 2:
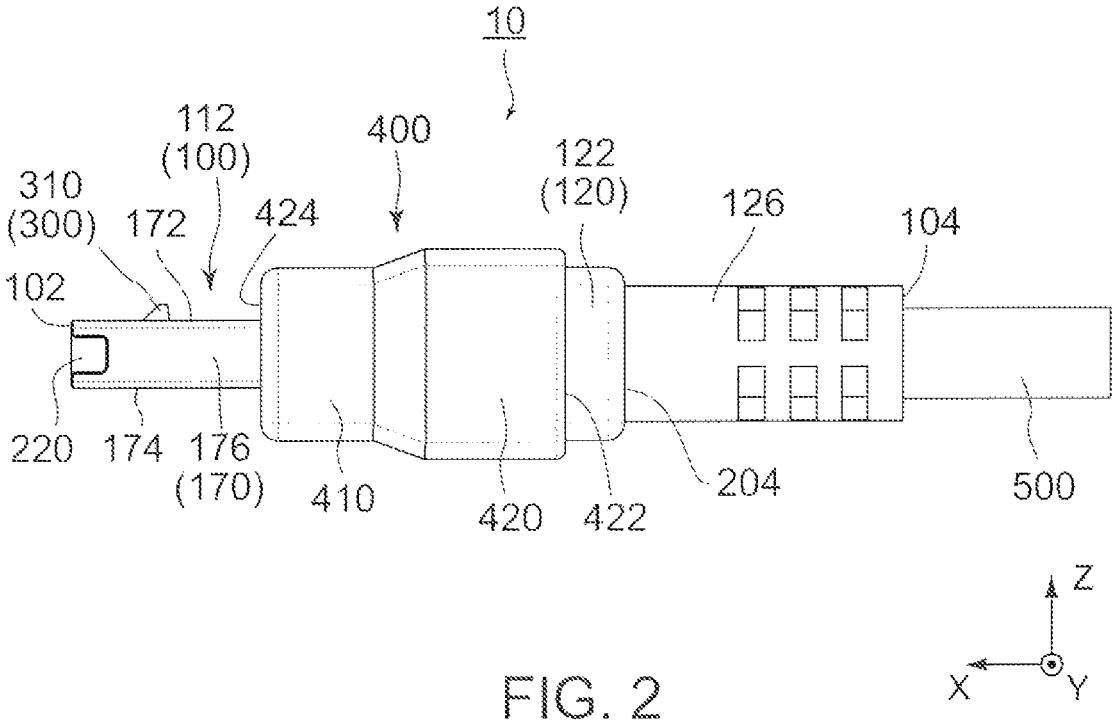
FIG. 2 is a side view showing the connector of FIG. 1.
Figure 3:
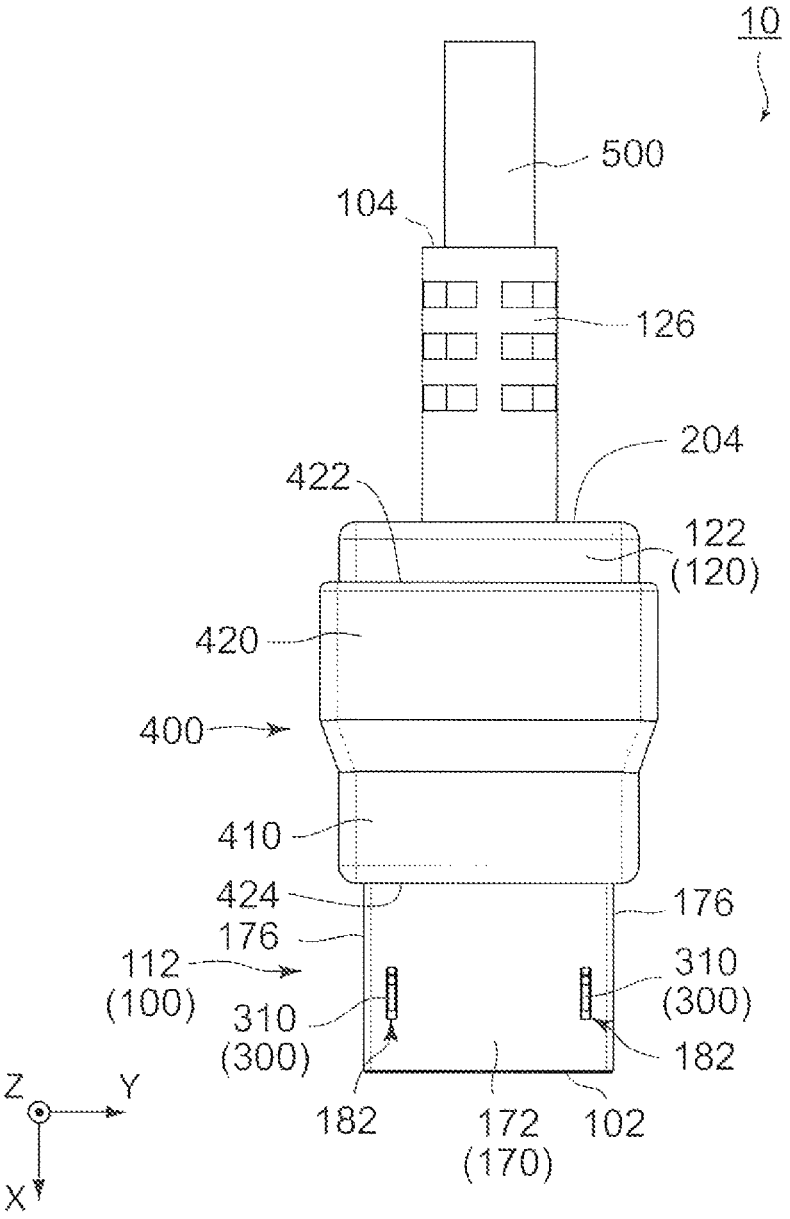
FIG. 3 is a plan view showing the connector of FIG. 1.
Figure 4:
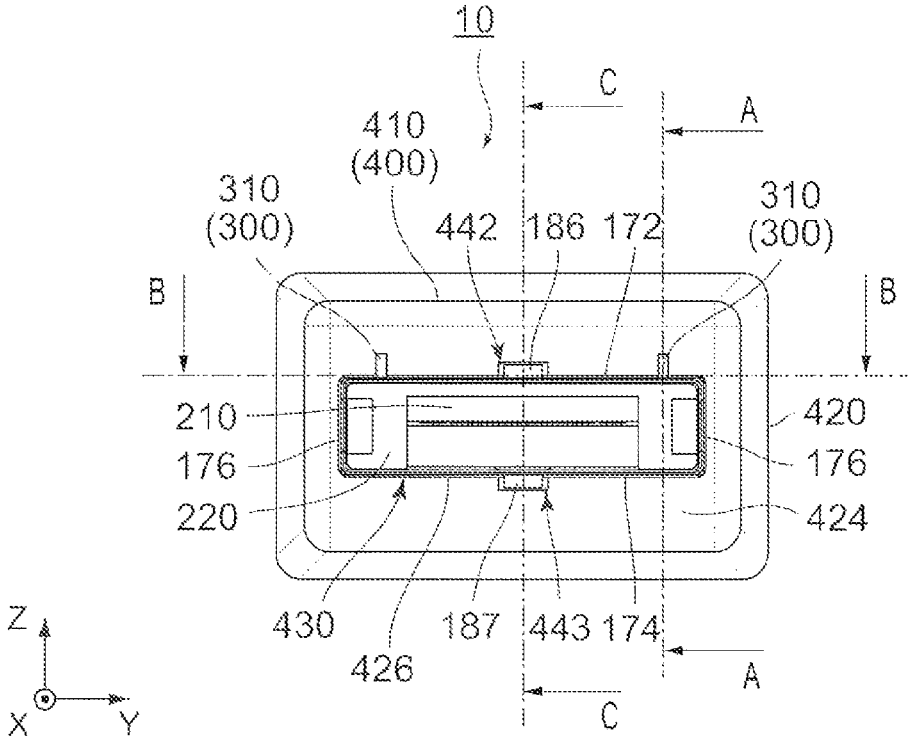
FIG. 4 is a front view showing the connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 12, a connector 10 according to an embodiment of the present invention is provided with a connector main member 100 and a front hood (an operation member) 400 and attached to an end of a cable 500. The connector 10 is mateable with a mating fitting portion of a mating connector, which is not shown, along a front-rear direction. In detail, the connector 10 has a fitting portion 112 which is located forward of the front hood 400 in a mated state where the connector 10 is mated with the mating connector (not shown). The fitting portion 112 is mateable with the mating fitting portion (not shown) of the mating connector. In the present embodiment, the front-rear direction is an X-direction. A positive X-direction is forward and a negative direction is rearward.

As understood from FIGS. 1 to 3, FIGS. 5 to 10 and FIG. 12, the front hood 400 is attached to the connector main member 100 to be movable in the front-rear direction. In detail, the front hood 400 is movable between a front limitation position and a rear limitation position in the front-rear direction. The connector main member 100 has a front regulating portion and a rear regulating portion which define the front limitation position and the rear limitation position, respectively, as described later.

Figure 13:
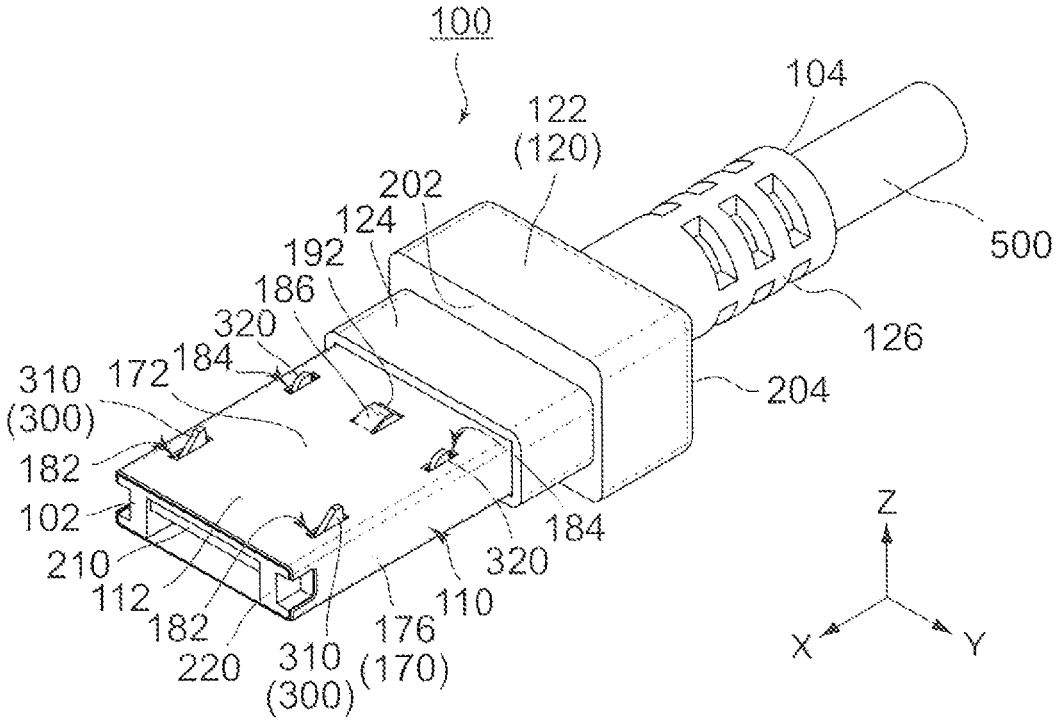
FIG. 13 is a perspective view showing a connector main member.
Figure 14:
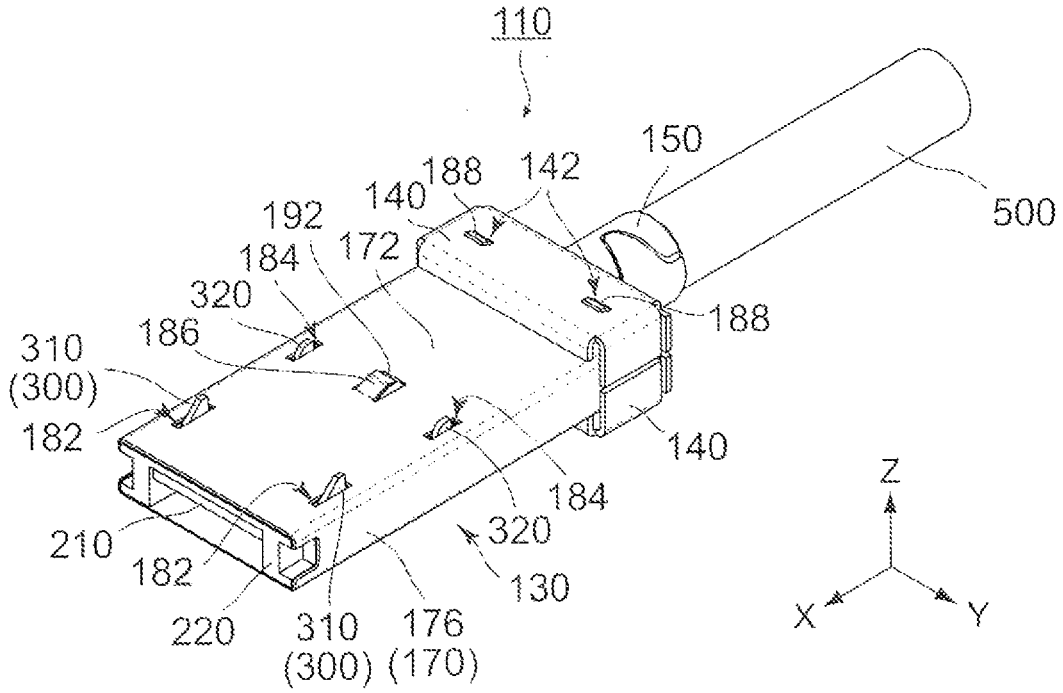
FIG. 14 is a perspective view showing a connector assembly included in the connector main member of FIG. 13.
Figure 15:
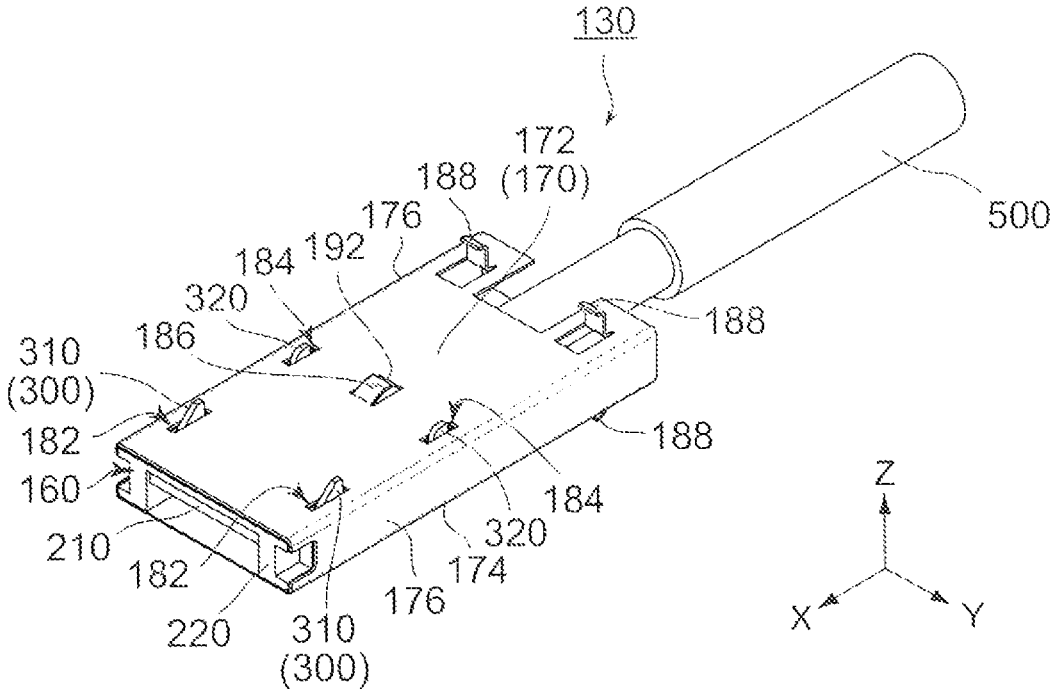
FIG. 15 is a perspective view showing a connector body included in the connector assembly of FIG. 14.
Figure 16:
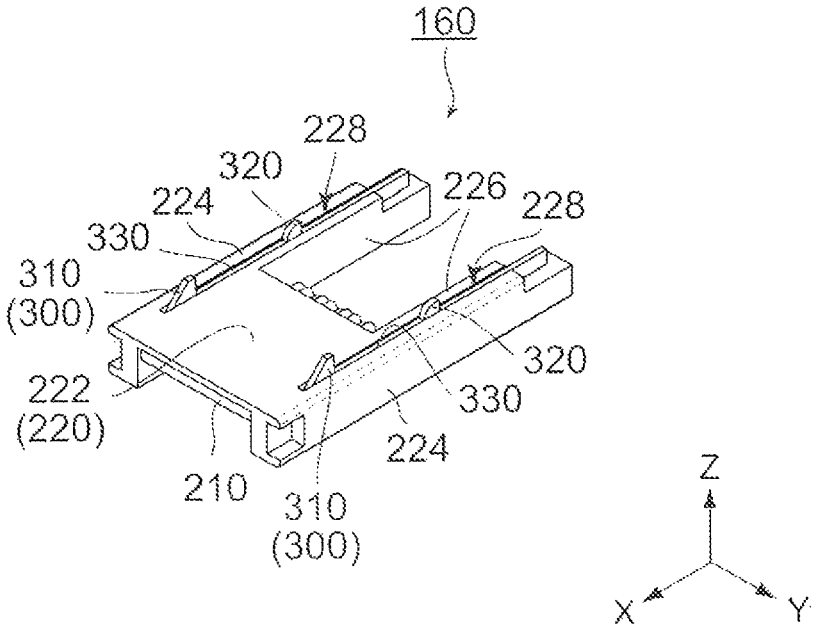
FIG. 16 is a perspective view showing a connection mechanism included in the connector body of FIG. 15. The connection mechanism illustrated holds lock members.

Referring to FIGS. 13 and 14, the connector main member 100 has a connector assembly 110 and a rear hood (holding member) 120. Referring to FIGS. 14 and 15, the connector assembly 110 has a connector body 130, a pair of lock members 300, a pair of rear shields 140 and a crimping portion 150. Referring to FIGS. 15 and 16, the connector body 130 has a connection mechanism 160 holding the lock members 300 and a shielding member 170. A part of the connector body 130 forms the fitting portion 112.

As shown in FIG. 16, the connection mechanism 160 has a substrate 210 and a housing 220. The housing 220 is made of insulating resin. The housing 220 holds the substrate 210 and the lock members 300. The substrate 210 and the lock members 300 are separated by the housing 220 from each other. In the present embodiment, the substrate 210 is a circuit board which has a rectangular shape in plan view and is a relatively small. A front portion (a part in a positive X-direction) of the substrate 210 is formed with a plurality of connection pads (not shown). These connection pads are in contact with mating contacts (not shown), respectively, when the connector 10 and the mating connector (not shown) are in the mated state. A rear part (a part in a negative X-direction) of the substrate 210 is formed with a fixing pad (not shown) which is used to be connected with the cable 500. In the present invention, the connection mechanism 160 has the substrate 210. However the present invention is not limited thereto. The connection mechanism 160 may have a plurality of contacts corresponding to the mating contacts. In such a case, the plurality of the contacts may be held by the housing 220.

As understood from FIG. 16, the housing 220 has a main portion 222 with a rectangular shape in plan view and two side portions 224 which are provided at both sides of the main portion 222 in a right-left direction. In other words, the main portion 222 is located between the two side portions 224 in the right-left direction. In the present embodiment, the right-left direction is a Y-direction perpendicular to the front-rear direction (X-direction). The main portion 222 holds the substrate 210 together with the side portions 224. The substrate 210 protrudes rearward (in the negative X-direction) of a rear end of the main portion 222 in part. The side portions 224 have arm portions 226 extending rearward (in the negative X-direction) of the rear end of the main portion 222. The side portions 224 hold the lock members 300. In detail, the side portions 224 are each formed with a channel 228. Each of the lock members 300 is accommodated in the channel 228 corresponding thereto in part.

As shown in FIG. 15, the shielding member 170 is made of a metal sheet and has an approximately rectangular cylindrical shape with a cross section which is long in the right-left direction and short in an up-down direction. As understood from FIG. 15, the shielding member 170 further has an upper surface 172, a lower surface 174 and two side surfaces 176. The shielding member 170 covers the substrate 210 and the housing 220 in part. In detail, the shielding member 170 covers the substrate 210 and the housing 220 in the up-down direction and the right-left direction. In the present embodiment, the up-down direction is a Z-direction perpendicular to both of the front-rear direction (X-direction) and the right-left direction (Y-direction). A positive Z-direction is upward while a negative Z-direction is downward. As understood from FIGS. 1 to 3 and FIGS. 8 to 10, the upper surface 172 of the shielding member 170 includes a part that forms one surface (upper surface) of an exterior of the fitting portion 112. Similarly, the lower surface 174 of the shielding member 170 includes a part that forms another surface (lower surface) of the fitting portion 112. Each of the upper surface 172, the lower surface 174 and the side surfaces 176 of the shielding member 170 need not necessarily be a single flat surface. Each of them may a stepped surface.

As understood from FIGS. 13 to 15, the upper surface 172 of the shielding member 170 is formed with two front opening portions 182 and two rear opening portions 184. Moreover, as understood from FIG. 7 and FIGS. 13 to 15, the upper surface 172 and the lower surface 174 of the shielding member 170 are formed with an upper protruding portion (protruding portion) 186 and a lower protruding portion (additional protruding portion) 187, respectively. In addition, as understood from FIGS. 7 and 15, vicinities of rear ends of the upper surface 172 and the lower surface 174 of the shielding member 170 are each formed with two hooks 188. The front opening portions 182 and the rear opening portions 184 are holes penetrating the metal sheet forming the shielding member 170. The front opening portions 182 and the rear opening portions 184 have rectangular shapes each of which is long in the front-rear direction. In the present embodiment, the upper protruding portion 186, the lower protruding portion 187 and the hooks 188 are each formed by partly cutting and bending the metal sheet forming the shielding member 170. As shown in FIG. 7, the upper protruding portion 186 protrudes upward from the upper surface 172 and extends rearward. On the other hand, the lower protruding portion 187 protrudes downward from the lower surface 174 and extends rearward. As understood from FIGS. 7 and 15, the hooks 188 have tip portions extending forward and protrude upward or downward. As understood from FIGS. 1 to 3 and FIG. 13, the front opening portions 182 are located in the fitting portion 112. The rear opening portions 184, the upper protruding portion 186 and the lower protruding portion 187 are located rearward of the fitting portion 112. As understood from FIG. 6, a position of the upper protruding portion 186 overlaps with a position of the rear opening portion 184 in the front-rear direction. The lower protruding portion 187 matches with the upper protruding portion 186 when seen along the up-down direction. As understood from FIGS. 1 to 3 and FIGS. 8 to 10, the upper protruding portion 186 and the lower protruding portion 187 are located inside the front hood 400. Accordingly, the upper protruding portion 186 and the lower protruding portion 187 are prevented from striking against something and being damaged.

In the present embodiment, the upper protruding portion 186 and the lower protruding portion 187 are formed by cutting and bending the metal sheet. However, they may be formed by a different method from the cutting and bending process. In the present embodiment, the upper surface 172 and the lower surface 174 are formed with the upper protruding portion 186 and the lower protruding portion 187, respectively. However, the present invention is not limited thereto. Any one of the upper surface 172, the lower surface 174 and the side surfaces 176 of the shielding member 170 may be formed with the protruding portion 186. The protruding portion 186 may be formed on the surface (upper surface 172) which is formed with the front opening portion 182 and the rear opening portion 184 or on another surface. The additional protruding portion 187 may be omitted, or a plurality of additional protruding portions may be provided. It is desirable that the additional protruding portion 187 is formed on a different surface from the surface on which the protruding portion 186 is formed. In other words, it is desirable that the additional protruding portion 187 protrudes in a direction which is perpendicular to the front-rear direction and different from the direction of the protruding portion 186. In a case where the protruding portion 186 is formed on the upper surface 172, the additional protruding portion(s) 187 may be formed on at least one of the side surfaces 176, for example. In a case where the number of the additional protruding portion 187 is one, it is more desirable that the additional protruding portion 187 protrudes in a direction opposite to the protruding direction of the protruding portion 186. In a case where the protruding portion 186 is formed on one of the side surfaces 176, it is desirable that the additional protruding portion 187 is formed on the other of the side surfaces 176. The protruding portion 186 and the additional protruding portions 187 may be formed to protrude in four directions of the up-down direction and the right-left direction.

As understood from FIG. 14, the rear shields 140 are attached to the shielding member 170 to sandwich a rear end of the shielding member 170 in the up-down direction. The rear shields 140 are made of metal sheets. The rear shields 140 are formed with opening portions 142 corresponding to the hooks 188. In a state where the rear shields 140 are attached to the shielding member 170, each of hooks 188 is located inside the opening portion 142 corresponding thereto in part. Each of the hooks 188 penetrates through the opening portion 142 corresponding thereto, and the tip portion thereof is located outside the opening portion 142. The rear shields 140 are regulated by the hooks 188 with respect to movement relative to the shielding member 170. A shape of the hooks 188 is particularly suitable to regulate rearward movement of the rear shields 140.

Figure 6:
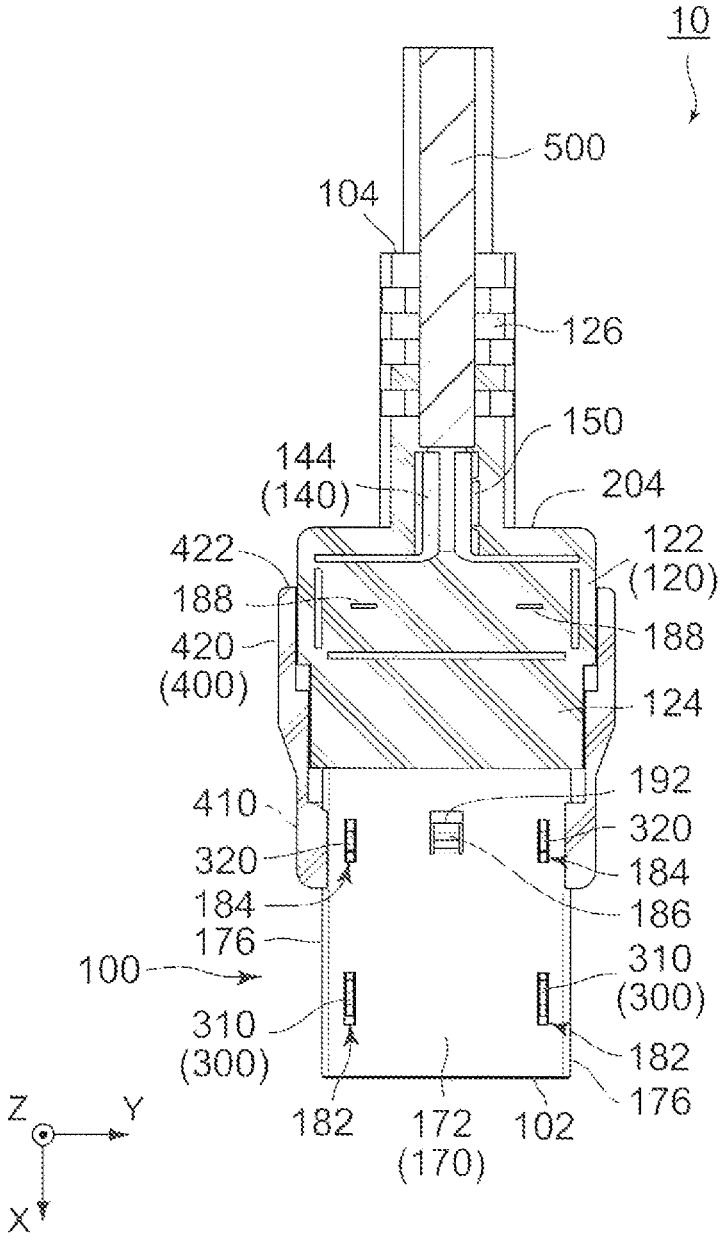
FIG. 6 is a sectional view showing the connector of FIG. 4 taken along B-B line.
Figure 7:
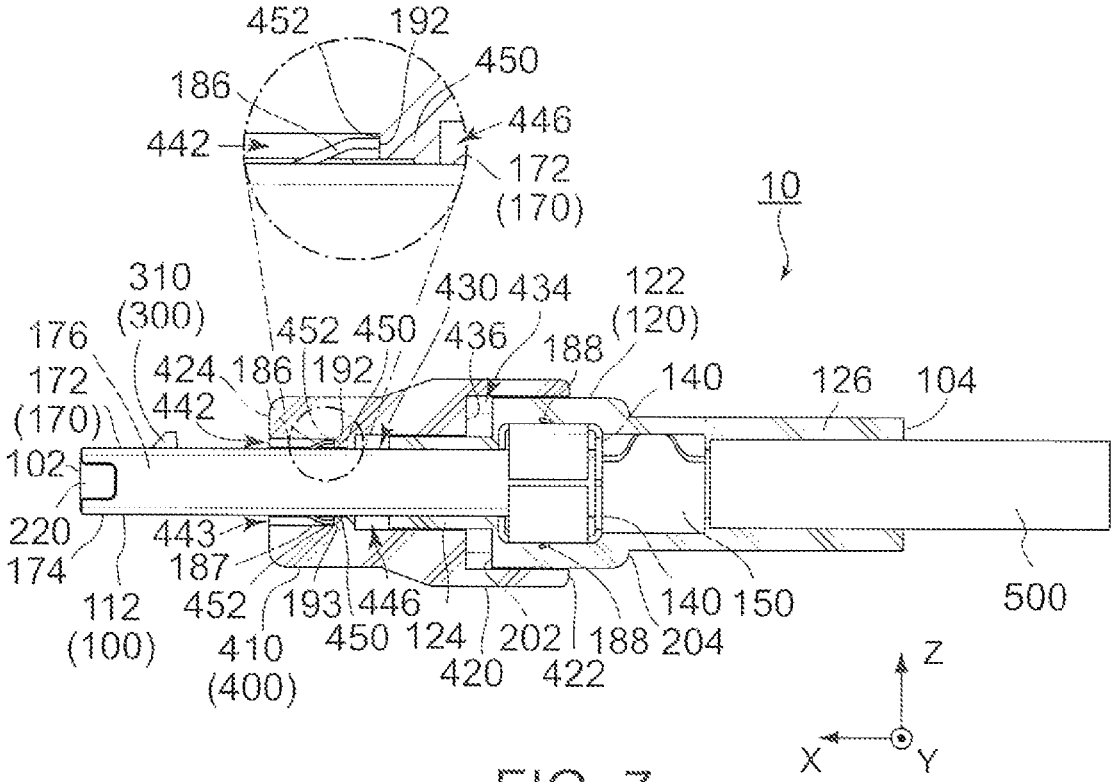
FIG. 7 is a sectional view showing the connector of FIG. 4. taken along C-C line. A connector assembly included in the connector is drawn as a side view. A vicinity of a protruding portion (a front regulating portion) is enlarged and drawn.
Figure 8:
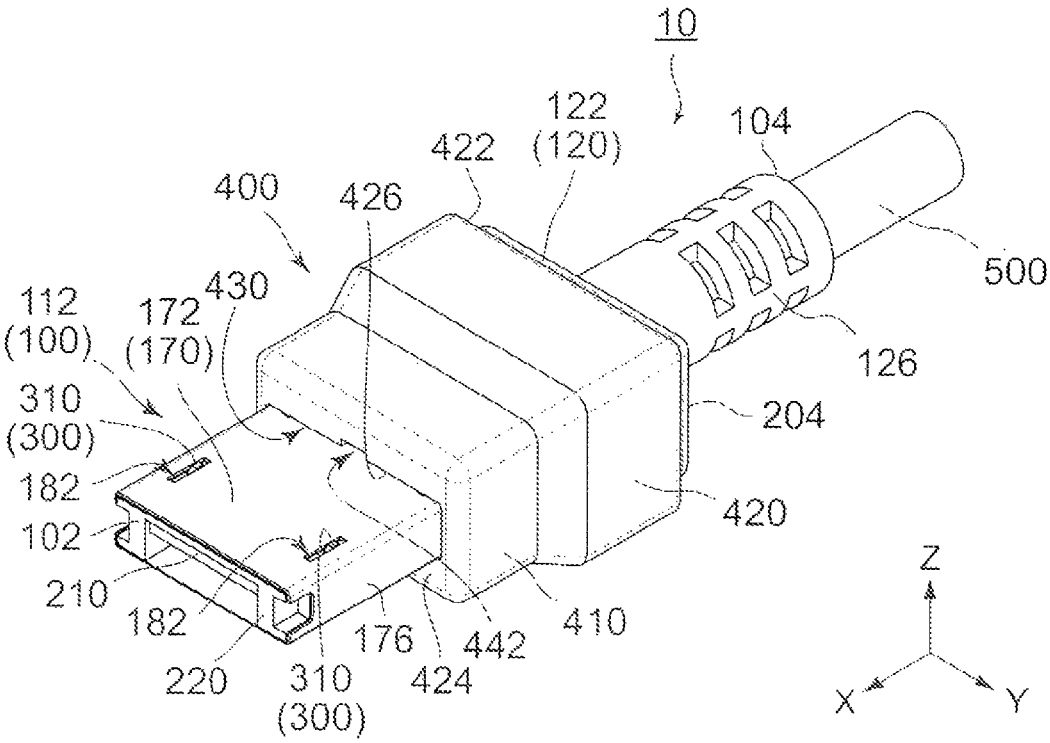
FIG. 8 is another perspective view showing the connector of FIG. 1. The front hood illustrated is positioned at a rear limitation position.
Figure 9:
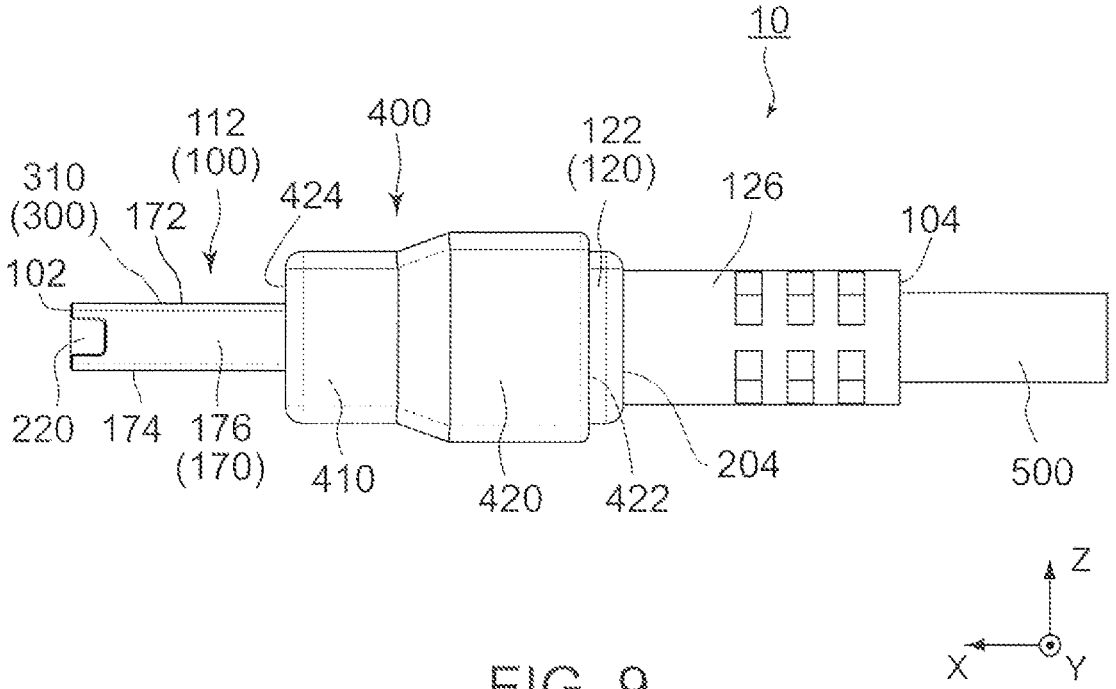
FIG. 9 is a side view showing the connector of FIG. 8.
Figure 10:
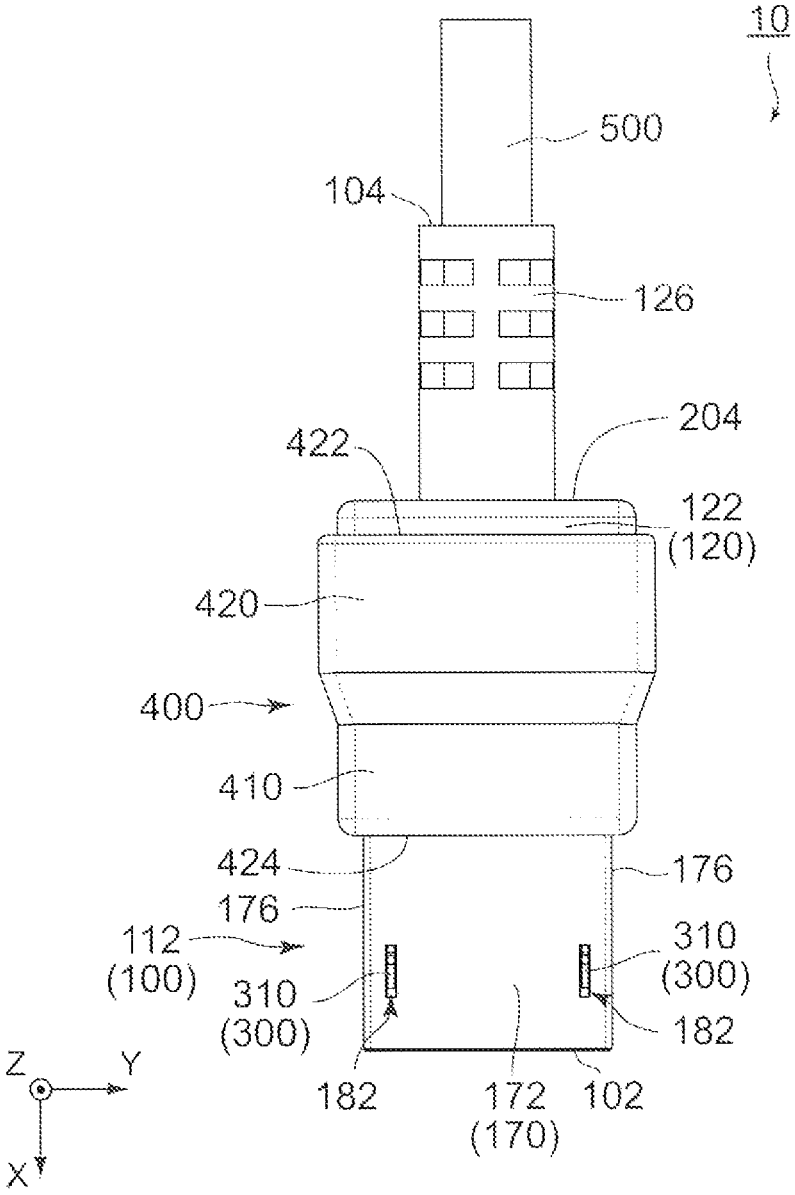
FIG. 10 is a plane view showing the connector of FIG. 8.
Figure 11:
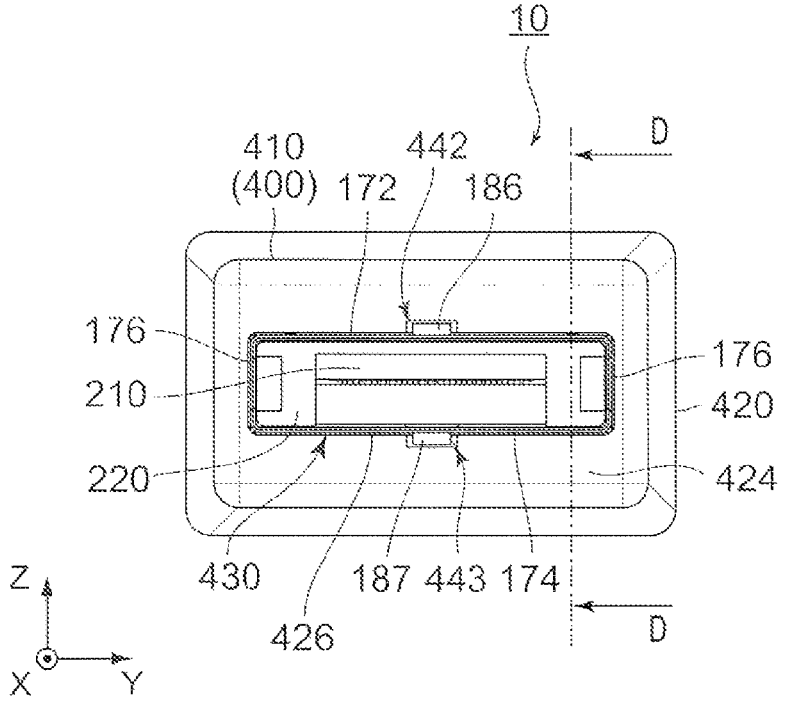
FIG. 11 is a front view showing the connector of FIG. 8.

As shown in FIG. 6, each of the rear shields 140 further has an extended portion 144 which extends rearward to cover the cable 500 in part and has a half cylindrical shape. As understood from FIGS. 6 and 7, the crimping portion 150 is made of a metal sheet and bent into a cylindrical shape to surround a circumference of the extended portion 144. The crimping portion 150 is crimped to fix the extended portions 144 to the cable 500. In other words, the cable 500 is fixed to the rear shields 140 by the crimping portion 150. Thus, the cable 500 is fixed to the shielding member 170 by the crimping portion 150 via the rear shields 140 and the hooks 188. Accordingly, when the cable 500 receives force directed rearward, the force is received by the shielding member 170. As a result, force acting between the cable 500 and the substrate 210 can be eliminated or reduced. Therefore, electrical disconnection between the cable 500 and the substrate 210 is prevented so that reliability is improved.

As shown in FIG. 13, the rear hood 120 has a main portion 122, a front protruding portion 124 and a cable covering portion 126. The rear hood 120 is made of insulating resin. The rear hood 120 is formed integrally with the connector assembly 110 by insert molding. Accordingly, a space between a surface of the shielding member 170 and each of inner surfaces of the pair of the rear shields 140 (see FIG. 14) is filled by the insulating resin forming the rear hood 120 (see FIGS. 7 and 12). The main portion 122 has an outer shape of an approximately rectangular parallel piped. The main portion 122 covers the rear shield 140 (see FIG. 14) except for the extended portions 144 (see FIG. 6). In other words, the main portion 122 covers a rear end of the connector assembly 110 (connector body 130). The front protruding portion 124 is a rectangular cylindrical portion protruding forward from the main portion 122 along the surfaces (the upper surface 172, the lower surface 174 and the side surfaces 176) of the shielding member 170. The cable covering portion 126 extends rearward from the main portion 122 and covers the extended portions 144 (see FIG. 6), the crimping portion 150 and a part of the cable 500 (see FIG. 14).

Figure 5:
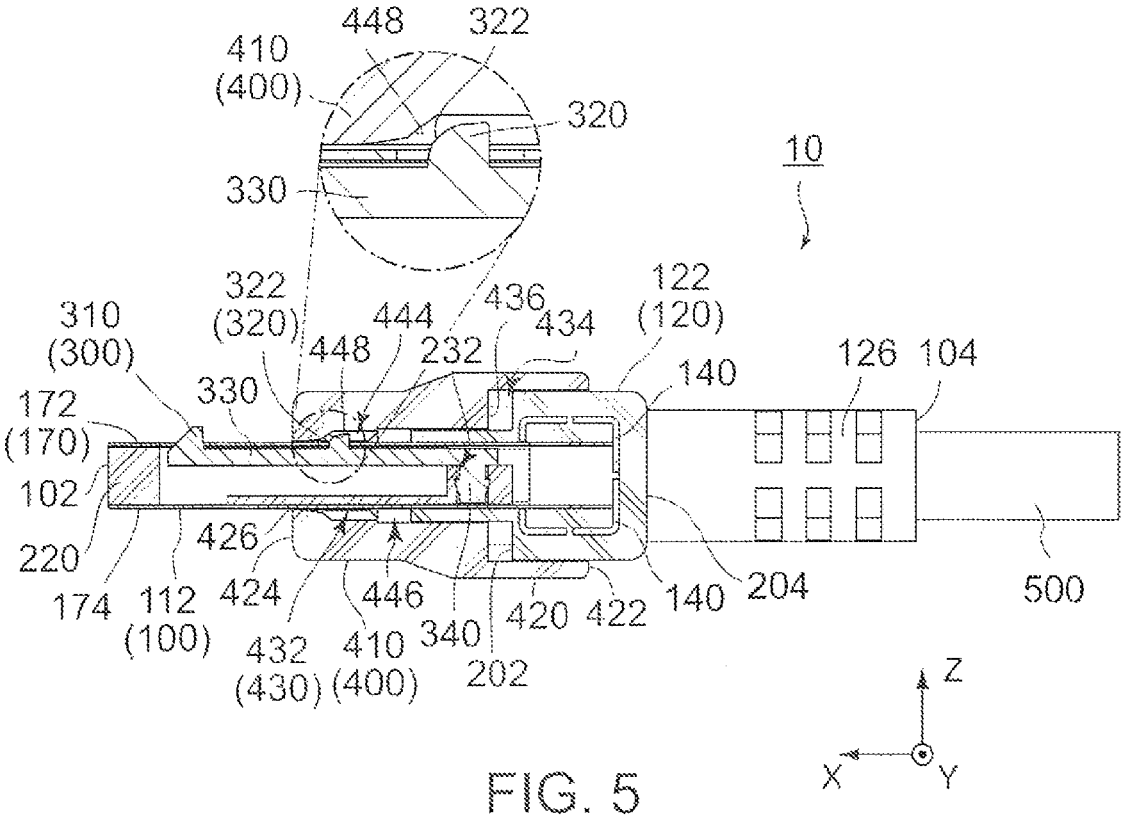
FIG. 5 is a sectional view showing the connector of FIG. 4, taken along A-A line. A vicinity of an operated portion of the connector (a part surrounded by a dashed line) is enlarged and drawn.
Figure 12:
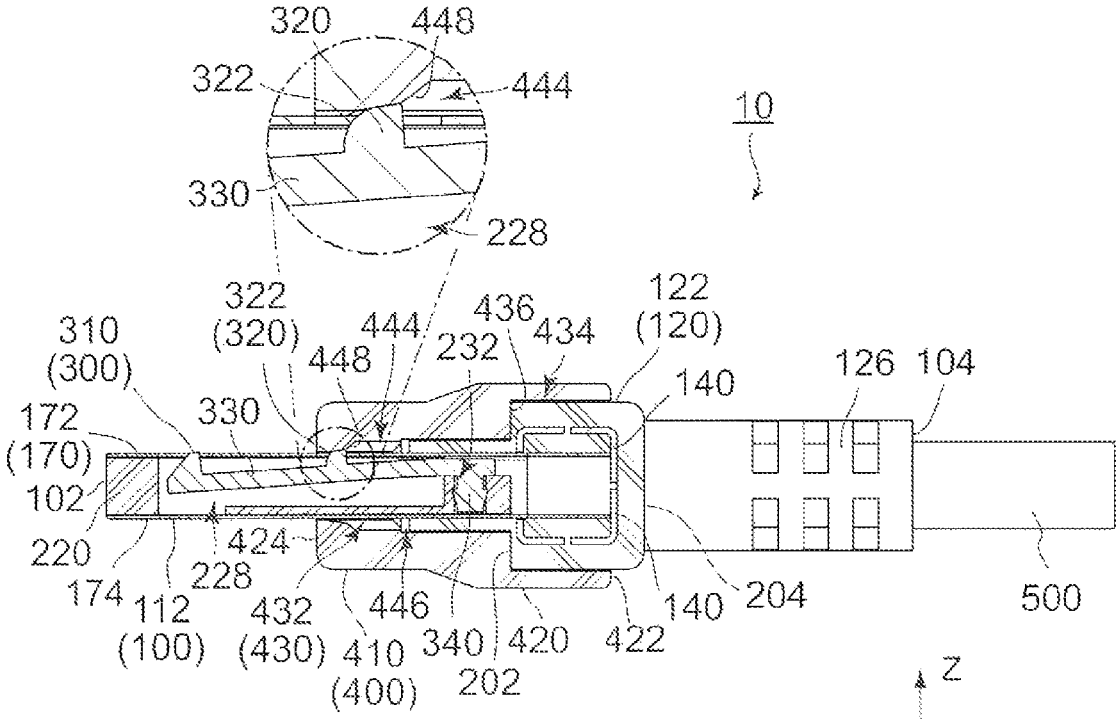
FIG. 12 is a sectional view showing the connector of FIG. 11, taken along D-D line. A vicinity of the operated portion of the connector is enlarged and drawn.

Referring to FIGS. 5 and 12, each of the lock members 300 has a lock portion 310, an operated portion 320, a spring portion 330 and a fixed portion 340. The lock portion 310 is a protrusion protruding upward from a front end portion of the spring portion 330. In the state illustrated in FIG. 5, a front surface of the lock portion 310 is an inclined surface diagonally intersecting with the front-rear direction. Moreover, a rear end surface of the lock portion 310 is a vertical surface perpendicular to the front-rear direction. The fixed portion 340 is a protrusion protruding downward from a rear end portion of the spring portion 330. The fixed portion 340 has a press-fit portion protruding in the front-rear direction. The operated portion 320 is a protrusion protruding upward from a middle portion between the front end portion and the rear end portion of the spring portion 330. A front surface of the operated portion 320 is a curved surface, a cross section of which draws an arc, while a rear end surface of the operated portion 320 is a vertical surface perpendicular to the front-rear direction. The operated portion 320 is smaller than the lock portion 310 in the front-rear direction and the up-down direction.

As shown in FIGS. 5 and 12, the fixed portion 340 is press-fit into and fixed to a press-fitted portion 232 formed in the housing 220. The spring portion 330 is supported by the fixed portion 340. The spring portion 330 is resiliently deformable and supports the lock portion 310 and the operated portion 320 to allow the lock portion 310 and the operated portion 320 to be moved at least in the up-down direction. The lock portion 310 corresponds to one of the front opening portions 182 of the shielding member 170 and is located inside the front opening portion 182 corresponding thereto at least in part. In other words, the lock portion 310 is located in the fitting portion 112. The operated portion 320 corresponds to the rear opening portion 184 and is located inside the rear opening portion 184 at least in part. In other words, the operated portion 320 is located rearward of the fitting portion 112. As understood from FIG. 6, a position of the operated portion 320 in the front-rear direction is most same as a position of the upper protruding portion 186 in the front-rear direction. In other words, the operated portion 320 overlaps with the upper protruding portion 186 when seen along the right-left direction. When seen along the right-left direction, a tip portion 192 of the upper protruding portion 186 may overlap with the operated portion 320 or may be located rearward of the operated portion 320.

As understood from FIGS. 5 and 12, the lock portion 310 is movable between a locked position (a position illustrated in FIG. 5) and a released position (a position illustrated in FIG. 12) which is located below the locked position by means of the resilient deformation of the spring portion 330. When the lock portion 310 is positioned at the locked position, it protrudes upward from the upper surface 172 of the shielding member 170 by a predetermined amount. The predetermined amount is predefined to certainly lock the mated state of the connector 10 with the mating connector (not shown). When the lock portion 310 is positioned at the released position, it does not protrude upward from the upper surface 172 of the shielding member 170. Alternatively, the lock portion 310 protrudes upward by an amount smaller than the predetermined amount. The operated portion 320 is interlocked with the lock portion 310. On the contrary, the lock portion 310 is interlocked with the operated portion 320. The operated portion 320 protrudes upward from the upper surface 172 of the shielding member 170 at least when the lock portion 310 is positioned at the locked position.

As shown, in FIGS. 1 to 12, the front hood 400 is made of insulating resin and has a front portion 410 and a rear portion 420. The rear portion 420 is larger than the front portion 410 in the up-down direction and the right-left direction, in the present embodiment, the rear portion 420 continues to the front portion 410 and has an inclined surface intersecting with the front-rear direction. However, the rear portion 420 may have a vertical surface perpendicular to the front-rear direction in place of the inclined surface.

As shown in FIGS. 5, 7 and 12, the front hood 400 further has a connector main member accommodation portion 430 penetrating therethrough in the front-rear direction. The connector main member accommodation portion 430 has a front accommodation portion 432 and a rear accommodation portion 434. The rear accommodation portion 434 is larger than the front accommodation portion 432 in the up-down direction and the right-left direction. Accordingly, the front hood 400 is formed with a step portion 436 therein between the front accommodation portion 432 and the rear accommodation portion 434. The main portion 122 of the rear hood 120 is accommodated in the rear accommodation portion 434 in part and located rearward of the step portion 436. A rear end portion 422 of the front hood 400 is located rearward of a front end surface 202 defining an front end of the main portion 122 and forward of a rear end 204 of the main portion 122. The front portion 410 of the front hood 400 does not necessarily correspond to the front accommodation portion 432. Similarly, the rear portion 420 of the front hood 400 does not necessarily correspond to the rear accommodation portion 434 of the front hood 400.

As shown in FIG. 7, the front hood 400 has a front regulating portion accommodation portion 442 therein. The front regulating portion accommodation portion 442 accommodates at least the tip portion 192 of the upper protruding portion 186. The front hood 400 further has an additional front regulating portion accommodation portion 443 therein. The additional front regulating portion accommodation portion 443 accommodates at least a tip portion 193 of the lower protruding portion 187. Furthermore, as shown in FIGS. 5 and 12, the front hood 400 has an operated portion accommodation portion 444 therein. The operated portion accommodation portion 444 accommodates the operated portion 320. In addition, as shown in FIGS. 5, 7 and 12, the front hood 400 has a front protruding portion accommodation portion (inner space) 446 therein. The front protruding portion accommodation portion 446 accommodates the front protruding portion 124. The front regulating portion accommodation portion 442, the additional front regulating portion accommodation portion 443, the operated portion accommodation portion 444 and the front protruding portion accommodation portion 446 communicate with to the front accommodation portion 432 of the connector main member accommodation portion 430. The operated portion accommodation portion 444 and the front protruding portion accommodation portion 446 are connected to each other. A rear end of the front protruding portion accommodation portion 446 opens to the rear accommodation portion 434 of the connector main member accommodation portion 430. The front regulating portion accommodation portion 442 and the additional front regulating portion accommodation portion 443 are channels which extend in the front-rear direction and open to a front end 424 of the front hood 400. As shown in FIG. 7, a partition wall (isolation portion) 450 is provided rearward of each of the front regulating portion accommodation portion 442 and the additional front regulating portion accommodation portion 443. Each of the partition walls 460 is located between the front regulating portion accommodation portion 442 or the additional front regulating portion accommodation portion 443 and the front protruding portion accommodation portion 446 to isolate them from each other. In the present embodiment, the front regulating portion accommodation portion 442 is located above the front accommodation portion 432 while the additional front regulating portion accommodation portion 443 is located under the front accommodation portion 432. On the other hand, the front regulating portion accommodation portion 442 and the additional front regulating portion accommodation portion 443 are provided inside the front hood 400 according to arrangement of the protruding portion 186, the number of the additional protruding portions 187 and arrangement of the additional protruding portions 187.

Figure 17:
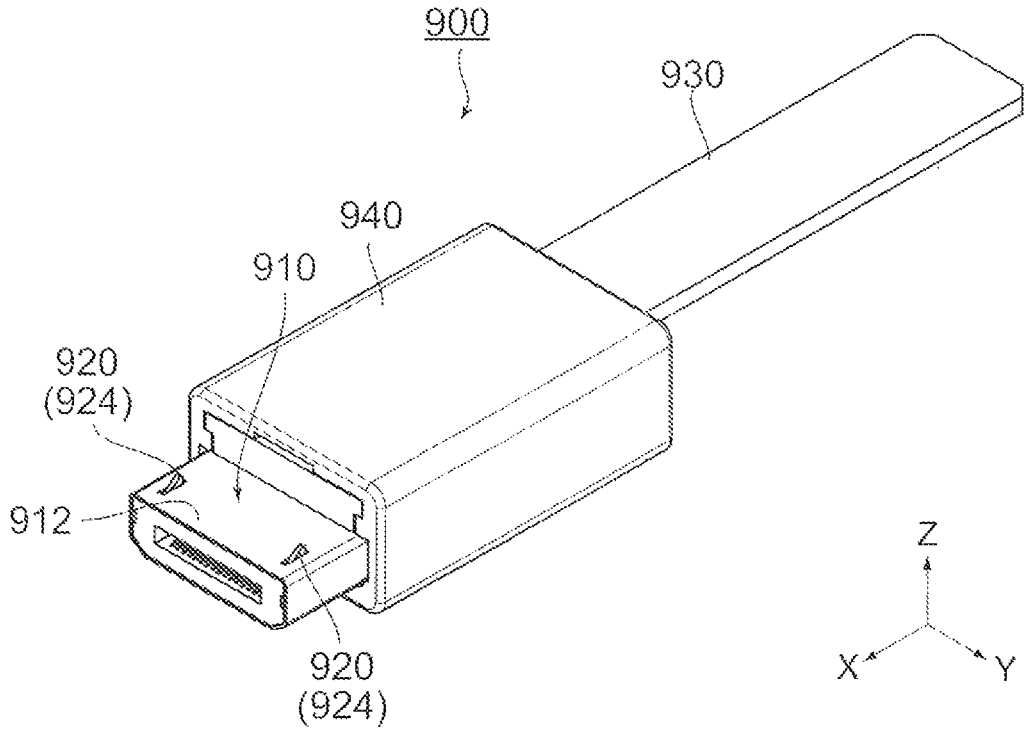
FIG. 17 is a perspective view showing a connector disclosed in Patent Document 1.
Figure 18:
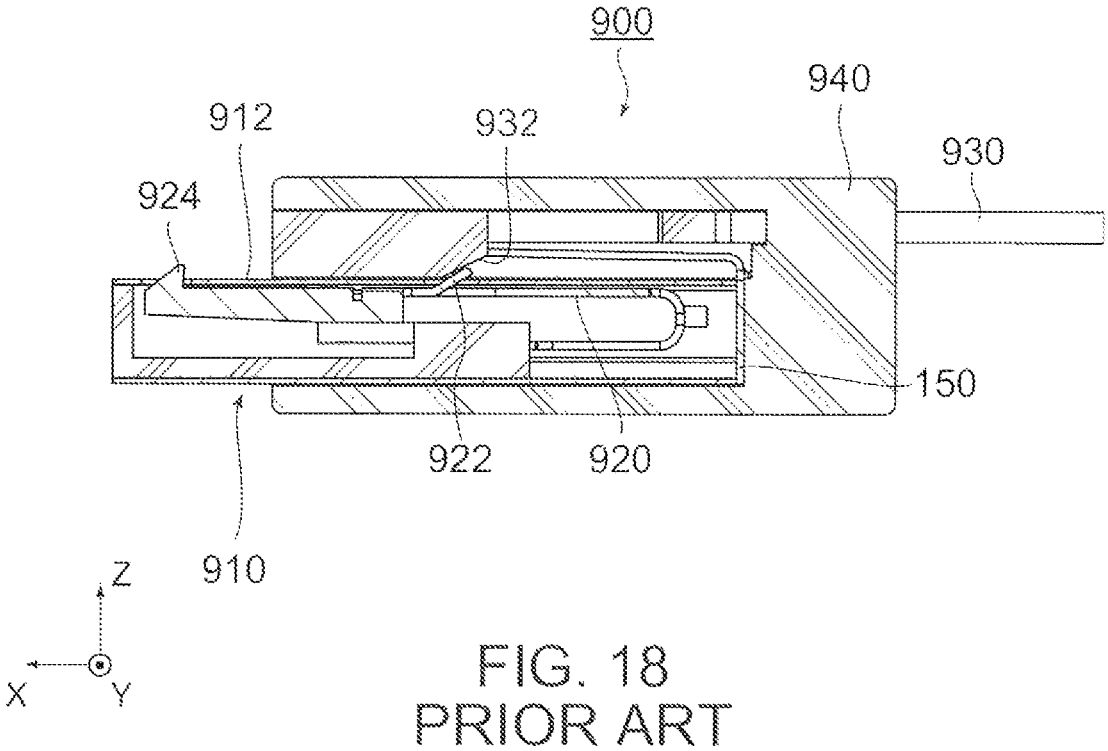
FIG. 18 PRIOR ART
FIG. 18 is a sectional view showing the connector of FIG. 17. Lock portions illustrated are positioned at a locked position.
Figure 19:
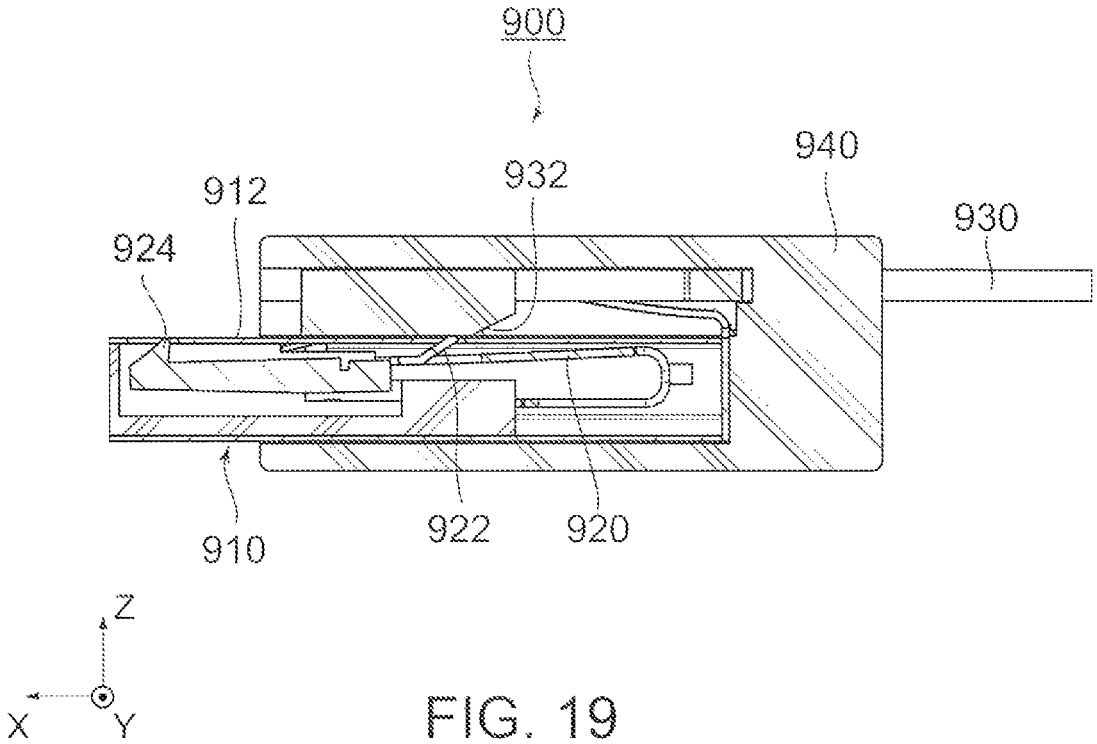
FIG. 19 PRIOR ART
FIG. 19 is another sectional view showing the connector of FIG. 17. The lock portions illustrated are positioned at a released position.

In the connector 10 having aforementioned structure, attachment of the front hood 400 to the connector main member 100 is achieved by covering the connector main member 100 with the front hood 400. In other words, this attachment is performed by sliding the front hood 400 rearward on the connector main member 100 from a front part of the connector main member 100 so that the connector main member 100 penetrates the front hood 400. Thus, the connector 10 of the present embodiment is easy to assemble. Therefore, the assembly ability is improved in comparison with that of the connector 900 (see FIGS. 17 to 19) of Patent Document 1. To allow the attachment of the front hood 400, as understood from FIG. 11, a front part of the connector main member 100 is smaller than an opening 426 of the front end 424 of the front hood 400 when seen along the front-rear direction. Here, the front part of the connector main member 100 is a part which is located forward of the front end 424 of the front hood 400 when the front hood 400 is positioned at the rear limitation position. The front part of the connector main member 100 includes the fitting portion 112.

As shown in FIGS. 1 to 3 and FIGS. 8 to 10, in the state where the front hood 400 is attached to the connector main member 100, a front end portion 102 and a rear end portion 104 of the connector main member 100 are located outside the front hood 400. A part of the connector main member 100 other than the front end portion 102 and the rear end portion 104 is located inside the connector main member accommodation portion 430 of the front hood 400. In other words, the connector main member 100 penetrates the front hood 400. Thus, the front hood 400 covers the whole circumference of the connector main member 100 in a plane perpendicular to the front-rear direction. The rear end portion 422 of the front hood 400 covers the circumference of the main portion 122 of the rear hood 120 in the plane perpendicular to the front-rear direction. Since the front hood 400 covers the whole circumference of the connector main member 100, an operator can hold the front hood 400 from any direction perpendicular to the front-rear direction. The operator can hold the front hood 400, for example, from the up-down direction or the right-left direction. Accordingly, the operator can easily operate the front hood 400. Thus the connector 10 has good usability. Since the front hood 400 covers the rear hood 120 in part, the rear hood 120 is prevented from being directly held by the operator to be operated. In a case where the rear hood 120 can be directly operated, it is possible to give rearward force on the connector main member 100 in a state where the lock portion 310 locks the mated state of the connector 10 with the mating connector (not shown). In such a case, the rearward force is received by the lock portion 310. In a case where the operator forgets or does not notice that the mated state is locked, there is possibility that significantly large force is given on the rear hood 120 to remove the connector 10 from the mating connector by force. In the present embodiment, the front hood 400 eliminates such possibility. Thus, the lock portion 310 is prevented from breaking due to excessive load. However, the front hood 400 need not necessarily cover the whole circumference of the connector main member 100 in the plane perpendicular to the front-rear direction. Provided that the relative movement of the front hood 400 with respect to the connector main member 100 in all directions in the plane perpendicular to the front-rear direction, the front hood 400 may cover the connector main member 100 in part. In such a case, the rear end portion 422 covers the main portion 122 at least in part in the plane perpendicular to the front-rear direction. At any rate, the connector main member 100 regulates the relative movement of the front hood 400 in all directions in the plane perpendicular to the front-rear direction, As understood from FIG. 7, when the front hood 400 is attached to the connector main member 100, the upper protruding portion 186 passes through the front protruding portion accommodation portion 446 and rides over the partition wall 450 to be accommodated in the front regulating portion accommodation portion 442. Since the upper protruding portion 186 passes through the front protruding portion accommodation portion 446, a distance (a length of the partition wall 450 in the front-rear direction) over which the upper protruding portion 186 is pressed against the front hood 400 can be shortened. This can prevent the front hood 400 from being remarkably shaved by the upper protruding portion 186. The whole of the upper protruding portion 186 need not be accommodated in the front regulating portion accommodation portion 442. At least the tip portion 192 of the upper protruding portion 186 has only to be accommodated in the front regulating portion accommodation portion 442. When the upper protruding portion 186 is accommodated in the front regulating portion accommodation portion 442 once, forward movement of the front hood 400 is regulated. That is, a front surface 452 of the partition wall 450 is brought into abutment with the tip portion 192 of the upper protruding portion 186, and then the front hood 400 cannot be moved forward. In other words, the front surface 452 of the partition wall 450 serves as a front regulated portion provided inside the front regulating portion accommodation portion 442. In this event, the tip portion 192 of the upper protruding portion 186 serves as the front regulating portion. Thus, the tip portion 192 of the upper protruding portion 186 defines the front limitation position of the front hood 400. The tip portion 192 of the upper protruding portion 186, i.e. the front regulating portion, is always located inside the front regulating portion accommodation portion 442. The lower protruding portion 187 is similar to the upper protruding portion 186. That is, the lower protruding portion 187 is accommodated in the additional front regulating portion accommodation portion 443, and the tip portion 193 serves as the additional front regulating portion. The front surface 452 of the partition wall 450 which defines a part of the additional front regulating portion accommodation portion 443 serves as an additional front regulated portion provided in the additional front regulating portion accommodation portion 443. In the present embodiment, the upper protruding portion 186 and the lower protruding portion 187 are formed on the upper surface 172 and the lower surface 174 of the shielding member 170, respectively. Accordingly, the front regulating portion and the additional front regulating portion act on the front hood 400 with good balance. As a result, posture of the front hood 400 which is positioned at the front limitation position is stabilized. A load is distributed in comparison with a case where a single protruding portion is provided. Accordingly, the upper protruding portion 186, the lower protruding portion 187 and the partition wall 450 are prevented from being broken.

As shown in FIG. 5, when the front hood 400 is positioned at the front limitation position, the operated portion 320 of the lock member 300 is accommodated in the operated portion accommodation portion 444. Furthermore, the front protruding portion 124 of the rear hood 120 is accommodated in the front protruding portion accommodation portion 446 in part. A part of the main portion 122 of the rear hood 120 is accommodated in the rear accommodation portion 434 of the connector main member accommodation portion 430.

As understood from FIGS. 5 and 12, during the front hood 400 is moved between the front limitation position and the rear limitation position, it slides on a surface of the front protruding portion 124 located in the front protruding portion accommodation portion 446. Though the front protruding portion 124 and the front protruding portion accommodation portion 446 are not necessarily essential, they enable the front hood 400 to slide smoothly. This is because friction drag between the front hood 400 made of resin and the shielding member 170 made of metal is smaller than friction drag between the front hood 400 made of resin and the front protruding portion 124 made of resin.

As shown in FIG. 12, when the front hood 400 is moved rearward, the step portion 436 is brought into abutment with the front end surface 202 of the main portion 122 of the rear hood 120. That is, rearward movement of the front hood 400 is regulated by the main portion 122. In other words, the front end surface 202 of the main portion 122 serves as the rear regulating portion defining the rear limitation position of the front hood 400. In accordance with movement of the front hood 400, the operated portion 320 slides on a front wall 448 of the operated portion accommodation portion 444 to be moved outward of the operated portion accommodation portion 444. In other words, the operated portion 320 is pressed inward of the connector main member 100 by the front wall 448. That is, the front wall 448 serves as an operating portion to operate the operated portion 320. The spring portion 330 is resiliently deformed in accordance with the movement of the operated portion 320 so that the lock portion 310 is moved to the released position. Thus, the operated portion accommodation portion 444 is provide, therein, with the operating portion to press the operated portion 320 inward of the connector main member 100 and to move the lock portion 310 to the released position when the front hood 400 is moved to the rear limitation position. In the present embodiment, the front wall 448 has a plurality of continuing flat surfaces which are intersecting with the front-rear direction. However, the structure of the front wall 448 is not limited thereto. The front wall 448 may be, for example, a single flat or curved surface intersecting with the front-rear direction. A front surface 322 of the operated portion 320 is a curved surface in the present embodiment. However, the front surface 322 may be a single flat surface intersecting with the front-rear direction or may be a plurality of flat surfaces intersecting with the front-rear direction and continuing to each other. At any rate, the front wall 448 and the operated portion 320 may be structured so that the operated portion 320 is pressed inward of the connector main member 100 in accordance with the movement of the front hood 400 and that the lock portion 310 is moved from the locked position to the released position. Only one of the front wall 448 and the front surface 322 of the operated portion 320 may have an inclined surface intersecting with the front-rear direction, for example.

As understood from FIGS. 1 to 12, mating of the connector 10 with the mating connector (not shown) is performed by moving the connector 10 to the mating connector located forward of the connector 10. In this event, the front hood 400 is moved to the front limitation position by operation of an operator. The front hood 400 may be previously moved forward (in a positive X-direction) with respect to the connector main member 100 before the mating. Alternatively, the front hood 400 may be moved forward with respect to the connector main member 100 by using frictional force when the connector 10 is mated with the mating connector. The front hood 400 is located at an outermost position of the connector 10 in the up-down direction and the right-left direction. Accordingly, the front hood 400 can be simply held by the operator. As shown in FIG. 5, in a state where the front hood 400 is positioned at the front limitation position and where the connector 10 does not receive external force, the operated portion 320 is accommodated in the operated portion accommodation portion 444, and the lock portion 310 is positioned at the locked position. The connector 10 in such a state is brought near to the mating connector, and the fitting portion 112 is inserted into the mating fitting portion (not shown). Then, the lock portion 310 positioned at the locked position comes into contact with the mating fitting portion. This is because an opening of the mating fitting portion is slightly larger than the fitting portion 112 in size when seen along the front-rear direction but not large enough to receive the lock portion 310 directly. When the lock portion 310 comes into contact with the mating fitting portion of the mating connector, it is pressed down within the channel 228 by resilient deformation of the spring portion 330. Accordingly, the lock portion 310 does not obstruct the mating of the connector 10 and the mating connector with each other. The mating fitting portion is provided with a locked portion (not shown) which receives the lock portion 310. When the connector 10 is in the mated state together with the mating connector, the lock portion 310 is received by the locked portion in part. Thus, the lock portion 310 locks the mated state of the connector 10 with the mating connector.

In the mated state of the connector 10 with the mating connector, the lock portion 310 is caught by the locked portion (not shown) when the cable 500 is pulled rearward. Accordingly, the connector 10 cannot be separated from the mating connector. On the other hand, as understood from FIG. 12, when the front hood 400 is moved rearward, it is moved to the rear limitation position. This is easy operation since the rear portion 420 of the front hood 400 is larger than the front portion 410 in the up-down direction and the right-left direction. In this event, the front wall 448 as the operating portion presses the operated portion 320 down. As a result, the spring portion 330 is resiliently deformed to move the lock portion 310 downward. When the lock portion 310 reaches the released portion, it is moved outside the locked portion (not shown). Then, the lock of the mated state is released. When the front hood 400 is tried to be further moved rearward, it is brought into abutment with the main portion 122 of the rear hood 120. Consequently. the connector main member 100 is pushed rearward. Thus, the connector 10 is separated from the mating connector.

Although the present invention is described based on the embodiment thereof, the present invention is not limited thereto. The present invention is applicable to various modification and alternatives.

In the aforementioned embodiment, the front regulating portion(s) is (are) formed as the part of the shielding member 170 (the tip portion 192 of the upper protruding portion 186 and the tip portion 193 of the lower protruding portion 187). However, the front regulating portion 192 may be formed as a part of another member (e.g. the lock member 300, the housing 22) and so on). In a case where the lock member 300 is provided with the front regulating portion, a protruding portion, which protrudes upward from the spring portion 330, may be formed between the lock portion 310 and the operated portion 320, and a part of the protruding portion may be used for the front regulating portion. In such a case, the shielding member 170 is provided with an opening portion corresponding to the front regulating portion. Furthermore, the front hood 400 is provided with a front regulating portion accommodation portion in front of the operated portion accommodation portion 444. In addition, the front hood 400 is provided with a partition portion having a front surface, which functions as the front regulated portion, between the operated portion accommodation portion 444 and the front regulating portion accommodation portion.

In the aforementioned embodiment, the rear regulating portion (the front end surface 202 of the rear hood 120) is located in the front hood 400. However, the rear regulated portion may be located outside of the front hood 400. In other words, the front hood 400 may not have the rear accommodation portion 434. That is, the front hood 400 may be formed so that the rear end portion 422 thereof is matched with the front end surface 202 of the main portion 122 of the rear hood 120 when the front hood 400 is positioned at the rear limitation position.

In the aforementioned embodiment, the lock member 300 is different and distinct from the connector body 130. However, the lock portion 310, the operated portion 320 and the spring portion 330 may be formed as parts of the connector body 130. For example, parts of the metal sheet, which forms the shielding member 170, may be cut and bent to form the lock portion 310, the operated portion 320 and the spring portion 330.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a front-rear direction, wherein:

the connector comprises a connector main member and an operation member, the connector main member has a fitting portion, a lock portion, an operated portion, a front regulating portion and a rear regulating portion;

the, lock portion is located in the fitting portion;

the operated portion is located rearward of the fitting portion;

the front regulating portion is located rearward of the fitting portion:

the lock portion is interlocked with the operated portion;

the lock portion is movable between a locked position and a released position;

the lock portion protrudes from the fitting portion by a predetermined amount when the lock portion is positioned at the locked position;

the lock portion does not protrude from the fitting portion when the lock portion is positioned at the released position, or the lock portion protrudes from the fitting portion by an amount smaller than the predetermined amount when the lock portion is positioned at the released position;

the operation member covers the connector main member at least in part in a plane perpendicular to the front-rear direction;

the operation member has a front limitation position and a rear limitation position in the front-rear direction;

the front limitation position and the rear limitation position are defined by the front regulating portion and the rear regulating portion, respectively;

the operation member is movable between the front limitation position and the rear limitation position in the front-rear direction;

the operation member has, therein, a front regulating portion accommodation portion accommodating the front regulating portion and an operated portion accommodation portion adapted to accommodate the operated portion;

the front regulating portion is always positioned inside the front regulating portion accommodation portion;

the front regulating portion accommodation portion is provided with a front regulated portion therein;

the front regulated portion is brought into abutment with the front regulating portion when the operation member is positioned at the front limitation position;

the operated portion accommodation portion is provided with an operating portion therein; and when the operation member is moved to the rear limitation position, the operating portion presses the operated portion inward of the connector main member to move the lock portion to the released position.

2. The connector as recited in claim 1, wherein:

the connector main member has at least one additional front regulating portion;

the operation member has, therein, an additional front regulating portion accommodation portion accommodating the additional front regulating portion;

the additional front regulating portion accommodation portion is provided with an additional front regulated portion therein; and the additional front regulated portion is brought into abutment with the additional front regulating portion when the operation member is positioned at the front limitation position.

3. The connector as recited in claim 2, wherein:

the number of the additional front regulating portion is equal to one;

the front regulating portion and the additional front regulating portion are provided on a protruding portion and an additional protruding portion, respectively; and the protruding portion and the additional protruding portion protrude in directions different from each other.

4. The connector as recited in claim 3, wherein the protruding portion and the additional protruding portion protrude in directions opposite to each other and perpendicular to the front-rear direction.

5. The connector as recited in claim 3, wherein the protruding portion and the additional protruding portion are always positioned inside the front regulating portion accommodation portion and the additional front regulating portion accommodating portion, respectively.

6. The connector as recited in claim 3, wherein the protruding portion and the lock portion protrude from an identical surface.

7. The connector as recited in claim 1, wherein:

the connector main member comprises a connector body and a holding member:

the fitting portion is provided on the connector body;

the holding member has a main portion which covers a rear end of the connector body;

the operation member has a rear end portion which is located rearward of a front end of the main portion; and the rear end portion covers the main portion at least in part in the plane perpendicular to the front-rear direction.

8. The connector as recited in claim 7, wherein:

the connector main member has a lock member which is different and distinct from the connector body; and the lock portion and the operated portion are formed as a part of the lock member.

9. The connector as recited in claim 8, wherein the front regulating portion is formed on a member different from the lock member.

10. The connector as recited in claim 9, wherein:

the connector body comprises a connection mechanism and a shielding member which covers the connection mechanism in part; and the front regulating portion is formed as a part of the shielding member.

11. The connector as recited in claim 7, wherein the rear regulating portion is a front end surface defining the front end of the main portion.

12. The connector as recited in claim 1, wherein the operation member covers an entire periphery of the connector main member in the plane perpendicular to the front-rear direction.

13. The connector as recited in claim 12, wherein:

the connector main member has a front part located forward of the operation member while the operation member has an opening of a front end thereof; and the front part of the connector main member is smaller than the opening of the operation member in size when seen along the front-rear direction.

14. The connector as recited in claim 1, wherein:

the operation member is provided with an inner space therein;

the operation member has a separating portion which separates the front regulating portion accommodation portion and the inner space from each other; and the separating portion has a front surface which works as the front regulated portion.

15. The connector as recited in claim 14, wherein the operated portion accommodation portion continues to the inner space.

16. The connector as recited in claim 14, wherein:

the holding member has a front protruding portion which is located inside the inner space at least in part; and the operation member is slidable on a surface of the front protruding portion.

17. The connector as recited in claim 1, wherein at least one of the operating portion and the operated portion has a surface intersecting with the front-rear direction.

18. The connector as recited in claim 1, wherein the front regulating portion overlaps with the operated portion when seen along a right-left direction perpendicular to the front-rear direction, or the front regulating portion is positioned rearward of the operated portion when seen along the right-left direction.

19. The connector as recited in claim 1, wherein the connector main member regulates movement of the operation member in all directions in the plane perpendicular to the front-rear direction.

* * * * *